United States Patent [19]

Matsuo et al.

[11] Patent Number: 4,505,428

[45] Date of Patent: Mar. 19, 1985

[54] RAIL FASTENING DEVICE

[75] Inventors: Yoshio Matsuo; Kentaro Matsubara, both of Tokyo, Japan

[73] Assignee: Tetsudo Kizai Kogyo Company Limited, Tokyo, Japan

[21] Appl. No.: 409,056

[22] Filed: Aug. 18, 1982

[30] Foreign Application Priority Data

Nov. 26, 1981 [JP] Japan ..... 56-174642[U]

[51] Int. Cl.[3] ..... E01B 9/30

[52] U.S. Cl. ..... 238/349; 238/360

[58] Field of Search ..... 238/310, 317, 322, 338, 238/349, 360

[56] References Cited

U.S. PATENT DOCUMENTS

| | | | |
|---|---|---|---|
| 1,863,039 | 6/1932 | Chandler | 238/322 X |
| 1,998,043 | 4/1935 | Boyd et al. | 238/349 X |
| 2,357,629 | 5/1944 | Cantrell et al. | 238/349 |
| 2,638,276 | 5/1953 | Stamm | 238/349 |
| 3,451,621 | 6/1969 | De Splinter | 238/349 X |
| 4,143,818 | 3/1979 | Matsubara et al. | 238/349 |
| 4,447,006 | 5/1984 | Matsuo | 238/349 X |

FOREIGN PATENT DOCUMENTS

| | | | |
|---|---|---|---|
| 143378 | 11/1935 | Austria | 238/349 |
| 2419352 | 11/1979 | France | 238/349 |
| 683961 | 12/1952 | United Kingdom | 238/349 |
| 973771 | 10/1964 | United Kingdom | 238/351 |
| 14343560 | 5/1976 | United Kingdom | 238/349 |

*Primary Examiner*—Randolph Reese

*Attorney, Agent, or Firm*—Howson and Howson

[57] ABSTRACT

A rail fastening device comprises a curved tapered spring having free ends adapted to engage a rail flange for preventing lateral and tilting motion of the rail. The spring is secured by a fastening element having a detent which is rotated and slid into a shaped hole in an anchor embedded in the tie on which the rail is supported.

4 Claims, 12 Drawing Figures

RAIL FASTENING DEVICE

FIELD OF THE INVENTION

This invention relates to a bolt-less device for fastening a rail to a tie.

BACKGROUND OF THE INVENTION

According to a known conventional method of fastening a rail to a tie, a single plate spring or a double-folded plate spring is placed on a tie in abutment with the flange of a rail and a spring seat, and then the plate spring is fastened to the tie with a bolt inserted downwardly through a hole in the plate spring. The disadvantage of this conventional method is that the bolt is likely to loosen due to vibrations caused by trains. Moreover, this arrangement permits the rail to be tilted by a transverse force applied to the rail by trains. Since the tilting action cannot be held below prescribed limits, the possibility of a derailment is increased.

OBJECTS OF THE INVENTION

Accordingly, an object of this invention is to eliminate the aforementioned disadvantages of conventional rail fastening devices.

SUMMARY OF THE INVENTION

More specifically, the present invention provides an improved rail fastening device utilizing a spring member having a lower portion terminating in a shaped free end adapted to engage the flange of a rail and an upper portion which tapers toward a free end which engages the topside of the rail flange. An anchor with a shaped hole projects upwardly through the lower portion and rotatably and slidably receives a fastening element having a cam lobe and a detent adapted, when rotated and slid axially into the anchor, to stress the spring member and fasten the rail flange to its underlying tie.

DESCRIPTION OF PREFERRED EMBODIMENT

Figure 1:
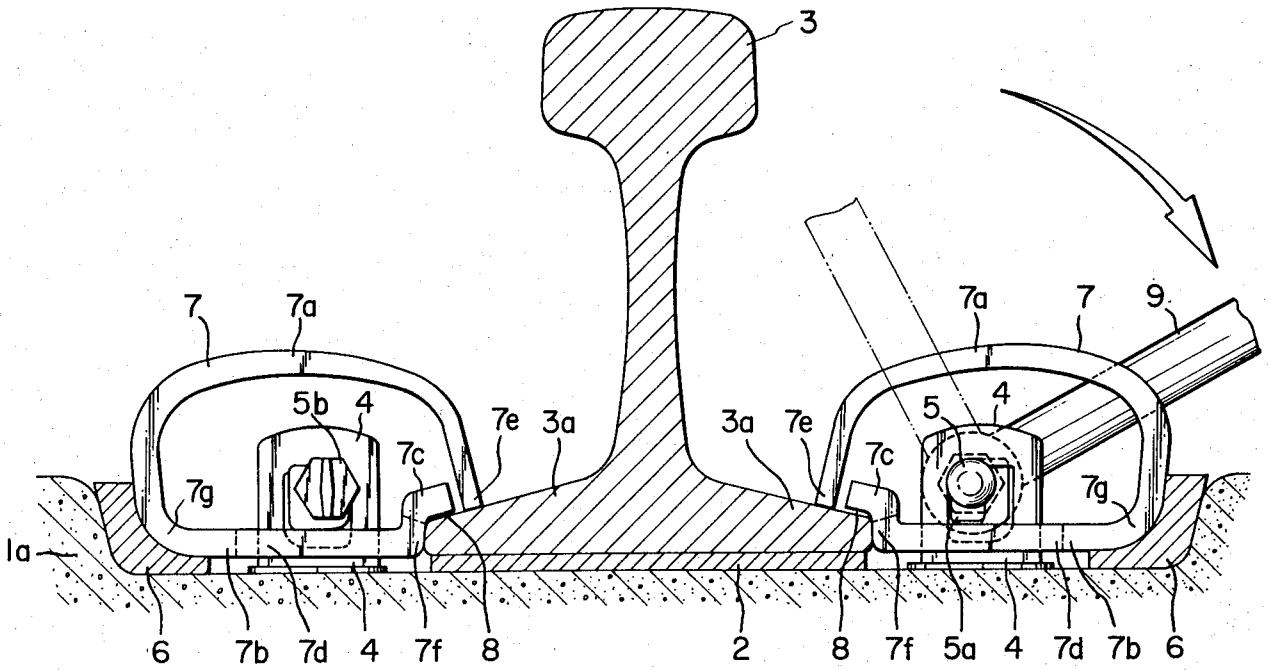
FIG. 1 is a front elevational view of a rail fastening device constructed according to the present invention.
Figure 2:
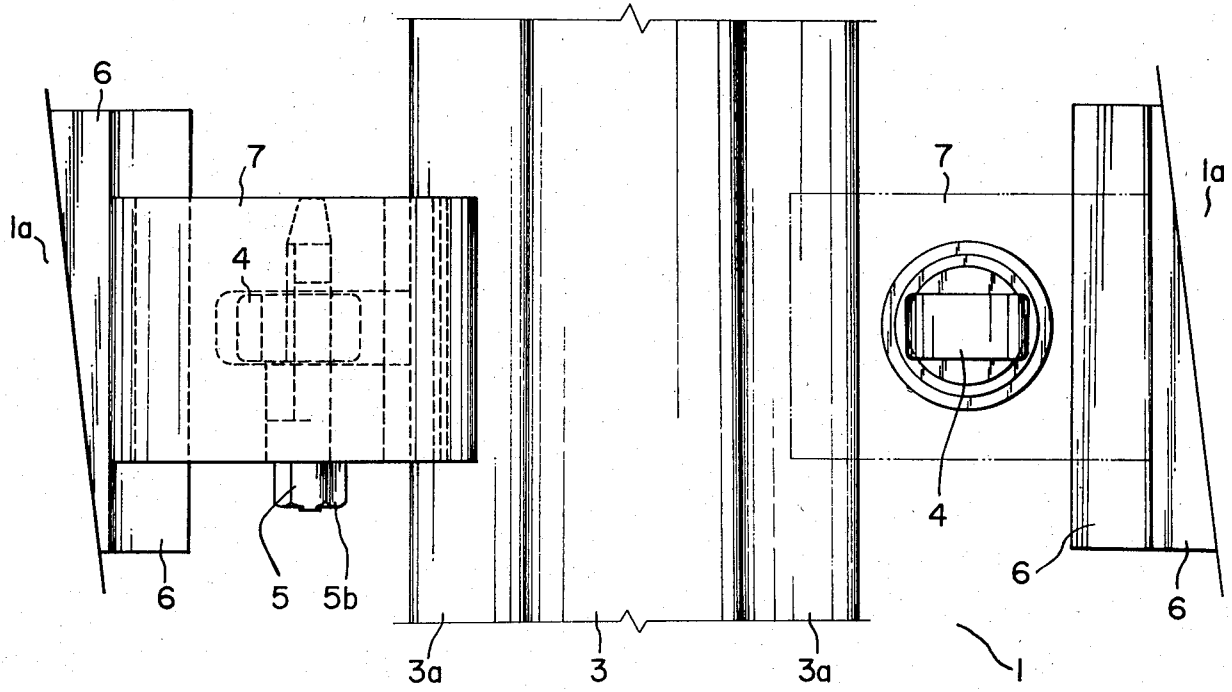
FIG. 2 is a plan view of the device illustrated in FIG. 1.

Referring now to FIGS. 1 and 2, 1 designates a tie on which a rail 3 is mounted with an insulating elastic pad 2 provided between the rail 3 and the tie 1. On each side of the flange 3*a* of the rail 3, a spring receiver 6 is placed on the tie 1 in abutment with a transverse pressure receiving protrusion 1*a* formed in the tie 1. A spring 7 is disposed between the spring seat 6 and the flange 3*a* and is fastened to the tie 1 by means of a fastening member 5 having a cam section which is inserted in a hole formed in the head of an anchor 4 and turned.

The spring 7 is formed by bending a single plate in a generally oval shape in elevation. The spring 7 has a predetermined length between its free ends 7*e* and 7*c*, and the thickness of the upper spring portion 7*a* of the spring 7 is tapered from a maximum thickness at about the middle of the length of the plate forming the spring 7 toward the free end 7*e* of the upper spring portion 7*a* to provide an optimum spring constant for the spring 7. The lower spring portion 7*b* has a horizontally-disposed flat portion connected to the upper spring portion 7*a* by a curved portion 7*g* which engages the spring receiver 6 placed in contact with the transverse pressure receiving protrusion 1*a* of the tie 1. The free end 7*e* of the upper spring portion 7*a* is adapted to press against the upper side of the flange 3*a*. The free end 7*c* of the lower spring portion 7*b* is formed by bending the lower spring portion 7*b* into dog-leg or crank-shape having a vertical portion 7*f* which engages against the side edge surface of the flange 3*a* and an inturned portion which overlies the upper surface of the flange 3*a* with a space 8 between the underside of the free end 7*c* and the upper surface of the flange 3*a*. A hole 7*d* for receiving the head of the anchor 4 is formed in the lower spring portion 7*b*.

As shown in FIG. 4, the fastening element or member 5 has an insertion guiding portion 5*d* formed at the tip, a cam portion 5*a* for depressing the lower spring portion 7*b* of the spring 7, a detent portion 5*c* extending perpendicularly with respect to the cam portion 5*a*, and a hexagonal head portion 5*b* adapted to be engaged by a wrench, the portions being formed successively and continuously along the fastening member proper.

Figure 3A:
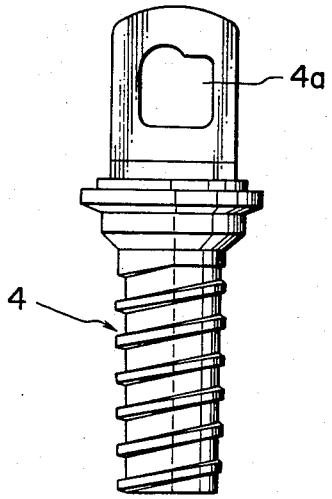
FIGS. 3*a*, 3*b* and 3*c* are a front elevational, a plan, and a longitudinal sectional view, respectively, of an anchor used in the present invention.
Figure 3B:
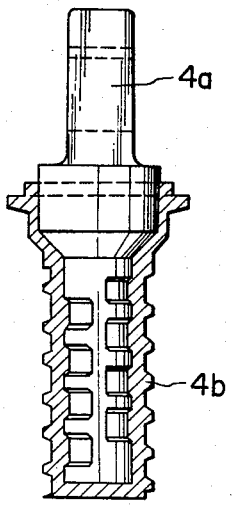
Figure 3C:
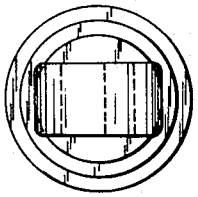
Figure 4A:
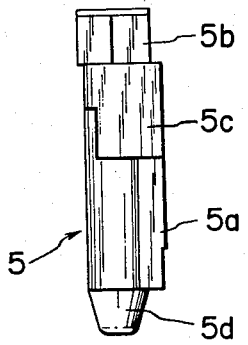
FIGS. 4*a*, 4*b*, 4*c* and 4*d* are a front elevational, a plan, a rear elevational as seen from the side of the insertion guiding part, and side elevational views respectively, of a fastening member used in the present invention.
Figure 4B:
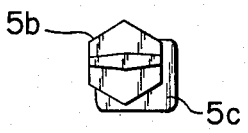
Figure 4C:
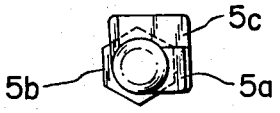
Figure 4D:
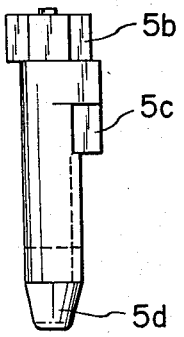

As best seen in FIG. 3*b* the anchor 4 has a root which is insulated by an insulating member 4*b* and which is buried in the tie 1. The head of the anchor 4 is exposed over the tie 1 and is received through the hole 7*d* of the lower spring portion 7*b*. A hole 4*a* is formed in the head of the anchor 4 for receiving the fastening member 5. As will be described, the fastening member 5 is inserted through the hole 4*a* and is turned to secure itself with respect to the lower spring portion 7*b*.

Figure 5A:
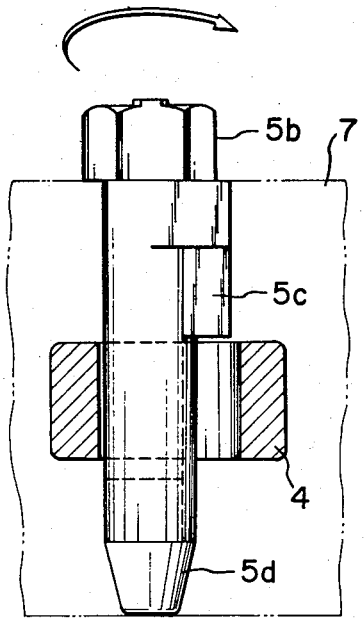
FIGS. 5*a*, 5*b* and 5*c* are views illustrating certain components of the device in various operative positions, FIG. 5*a* being a plan view in which the fastening member has been rotated into a fastening position, FIG. 5*b* being a plan view in which the fastening member has been driven into the hole in the anchor to a locking position, and FIG. 5*c* being a side elevational view of the fastening member according to the present invention to facilitate understanding of the function of the device.
Figure 5B:
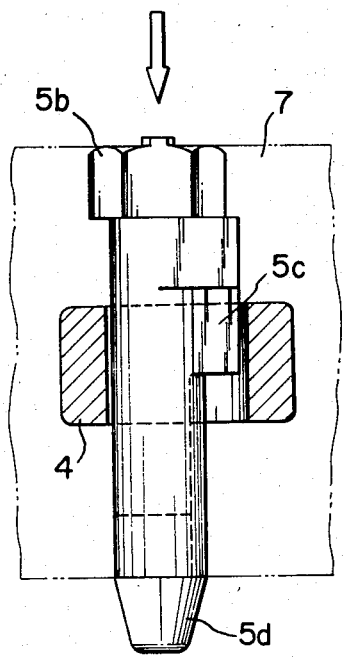
Figure 5C:
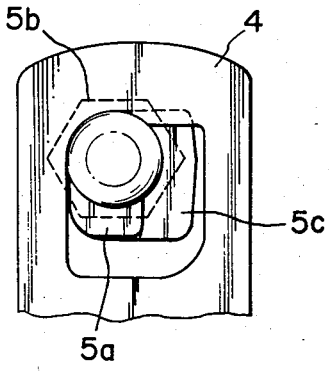

To assemble the rail fastening device, the spring 7 is fitted on the head of the anchor 4 and the spring receiver 6 with the free end 7*e* of the upper spring portion 7*a* placed in contact with the upper surface of the flange 3*a* and with the vertical part 7*f* pressed against the side edge of the flange 3*a* and with the curved part 7*g* pressed against the spring receiver 6. Thereafter, the fastening member 5 is inserted through the hole 4*a* formed in the head of the anchor 4 with the insertion guiding part 5*d* directed forward (downwardly in FIG. 5*a*) and the hexagonal head 5*b* directed rearward. During insertion, the cam section 5*a* is directed away from the rail. When the cam section 5*a* is aligned with the lower spring portion 7*b*, a wrench 9 is engaged with the hexagonal head 5*b* and is operated to turn the fastening member 5 as shown by the arrow in FIG. 1 into the solid line position. This causes the lower spring portion 7*b* to be depressed with the cam section 5*a*. Thereafter the fastening member 5 is driven into the hole of the anchor 4 by striking the hexagonal head 5*b* with a hammer until the detent surface section 5*c* of the fastening member 5 is engaged with a flat surface in the shaped hole 4*a* formed in the head of the anchor 4. This engagement prevents the fastening member 5 from turning in the reverse direction, i.e. in the direction opposite the arrows in FIG. 1. In this state, the underside of the free end 7*c* of the lower spring portion is spaced from the upper surface of the flange 3*a* by a suitable gap or space 8, for instance about 10 mm. The fastening member 5 can be removed by reversing the aforementioned procedure.

According to the rail fastening device of the present invention as described hereinbefore, when the rail is pushed outward with respect to the head thereof by a transverse pressure applied by trains, the rail tends to tilt or pivot lengthwise. This causes one flange to raise relative to the tie 1; however, the rising movement of the flange is restricted by the inturned portion of the free end 7*c* of the lower spring portion 7*b*. Thus, the free end 7*c* of the lower spring portion, and the thinner free end 7*e* of the upper spring portion of an optimum spring constant, cooperate to hold down the rail, while the vertical portion 7*f* of the free end 7*c* of the lower spring portion 7*b* restrains the rail from transverse movement. Accordingly, since the tilting of the rail can be effectively prevented, the derailing of trains due to increases in the track gauge can be prevented. Furthermore, since the rail fastening device of the present invention is not loosened by vibrations caused by trains, the disadvantages of the conventional bolt type fastening devices are eliminated.

We claim:

1. In a rail fastening device having a spring interposed between a spring receiver on a tie and the flange of a rail disposed on the tie, the improvement, wherein said spring includes a continuously bent plate having a generally oval shape with an upper spring portion and a lower spring portion, the upper spring portion having a free end adapted to engage the upper surface of the flange of the rail, the thickness of the upper spring portion being tapered from about the middle of the entire length of the spring toward the free end of the upper spring portion, the lower spring portion having a flat portion and a curved portion which engages said spring receiver on the tie, the lower spring portion having a free end with an upright bend to form a vertical portion which engages an edge of the rail flange and a lateral bend spaced from the upper side of the rail flange, an anchor fixed to the tie and having a head projecting upwardly through an opening formed in the lower spring portion, said head having a shaped hole with a locking surface spaced from said lower spring portion, a fastening member engaging said anchor for applying downward pressure to said lower spring portion, said fastening member having a guiding tip for guiding the fastening member through said hole in said anchor, a cam section adjacent said guiding tip for depressing the lower spring portion upon rotation of said fastening member relative to said anchor, a detent section adjacent said cam section for engaging said locking surface in said shaped hole in said anchor upon rotation of said cam section into engagement with said lower spring portion and sliding motion of said fastening member into said hole relative to said anchor, and a head adjacent said cam section for rotating the fastening member, said cam section cooperating with said locking surface in said anchor to apply continuous downward pressure on said lower spring portion while said detent section prevents reverse rotation of said fastening member.

2. A device for clamping a rail flange to a base, comprising: an anchor mounted in said base and having a head projecting upwardly therefrom with a shaped hole therein having a flat surface, a fastening element mounted in said anchor for rotation about an axis parallel to said rail flange and for sliding motion lengthwise of its rotational axis, a spring member having an upper portion overlying said anchor and a lower portion receiving said upper portion of said anchor, said upper portion terminating in a downward free end engaging said rail flange and said lower portion terminating in a free end adjacent said rail flange, means located outwardly of said anchor supporting said spring member remote from its free ends, said fastening element having a cam lobe for engaging said lower spring portion, a detent surface disposed at an angle relative to said cam lobe, and means for rotating said fastening element, said shaped hole in said anchor head affording rotation of said fastening means to cause said cam lobe to deflect said lower spring portion downwardly and to afford longitudinal sliding motion of said fastening means in said rotated position for engaging said detent surface with said flat surface in said anchor head hole to prevent inadvertent reverse rotation of said fastening means.

3. A device for clamping a rail flange to a base, comprising: an anchor mounted in said base and having a head projecting upwardly therefrom, said head having a hole with a non-circular shape, a fastening element mounted in said anchor for rotation about an axis parallel to said rail flange and for sliding motion lengthwise of its rotational axis, a spring member having an upper portion overlying said anchor and a lower portion receiving said upper portion of said anchor, said upper portion terminating in a downturned free end engaging said rail flange and said lower portion terminating in a free end having an upturned portion disposed laterally of said flange and an inturned portion overlying said flange, means located outwardly of said anchor supporting said spring member remote from its free ends, said fastening element having a cam lobe, a detent axially adjacent said cam lobe, and means for rotating said cam lobe, said fastening element cam lobe adapted, when rotated in one direction into engagement with said lower portion of the spring member, to depress said lower portion of the spring member and to maintain the same depressed as said fastening element is slid axially relative to said anchor for causing said detent to slide axially into engagement with said anchor hole and thereby to prevent reverse rotation of said fastening element, whereby said inturned portion of said spring element engages said rail flange to limit tilting of said flange relative to said base.

4. A device for clamping a rail flange to a base, comprising: an anchor mounted in said base and having a head projecting upwardly therefrom, said head having a hole with a non-circular shape, a fastening element mounted in said anchor for rotation about an axis parallel to said rail flange and for sliding motion lengthwise of its rotational axis, a spring member having an upper portion overlying said anchor and a lower portion receiving said upper portion of said anchor, said upper portion terminating in a downturned free end engaging said rail flange and said lower portion terminating in a free end shaped to engage said rail flange when tilted about its longitudinal axis, means located outwardly of said anchor supporting said spring member remote from its free ends, said spring member having a predetermined length between said free ends with said upper portion of said spring member having a thickness which decreases from a maximum thickness located at about the middle of said predetermined length, said fastening element having a cam lobe and a detent adapted, when the fastening element is rotated in one direction to cause the cam lobe to engage and to depress said lower portion of the spring member while being slid axially therealong into a locking position relative to said anchor wherein said detent engages in said hole in said head of said anchor for preventing reverse rotation of said fastening element.

* * * * *